United States Patent [19]

Macabee

[11] 4,441,488

[45] Apr. 10, 1984

[54] HYDRO-AIR VIBRATOR MASSAGE APPARATUS

[75] Inventor: L. Cedric Macabee, Scotts Valley, Calif.

[73] Assignee: David K. Macabee, Carlsbad, Calif.

[21] Appl. No.: 232,952

[22] Filed: Feb. 9, 1981

Related U.S. Application Data

[63] Continuation of Ser. No. 121,363, Feb. 14, 1980, abandoned.

[51] Int. Cl.[3] ..... A61H 9/00

[52] U.S. Cl. ..... 128/66

[58] Field of Search ..... 128/66

[56] References Cited

U.S. PATENT DOCUMENTS 1,198,544 9/1916 Heal ..... 128/66

2,701,563 2/1955 Fortin ..... 128/66

3,541,616 11/1970 Stricker ..... 128/66

*Primary Examiner*—Richard J. Apley

*Assistant Examiner*—David J. Brown

[57] ABSTRACT

A water massage device with entrained air is held against the region to be massaged. Mechanical displacement of the device coupled with pulsations in the water-air flow create a gentle massage. Air is entrained by passing a high velocity water jet across an air gap and through a receiving tube into a rotor chamber. Differential pressures developed in the housing establishes an air draw through the receiving tube into the housing. An eccentrically weighted rotor revolves under the impact of the jet causing the entire device to counter rotate creating the massage displacement. Each blade of the rotor developes a high pressure leading zone which sweeps away spent water. Each blade also developes a low pressure trailing zone as the blade passes the receiving tube, which favors the air draw.

27 Claims, 12 Drawing Figures

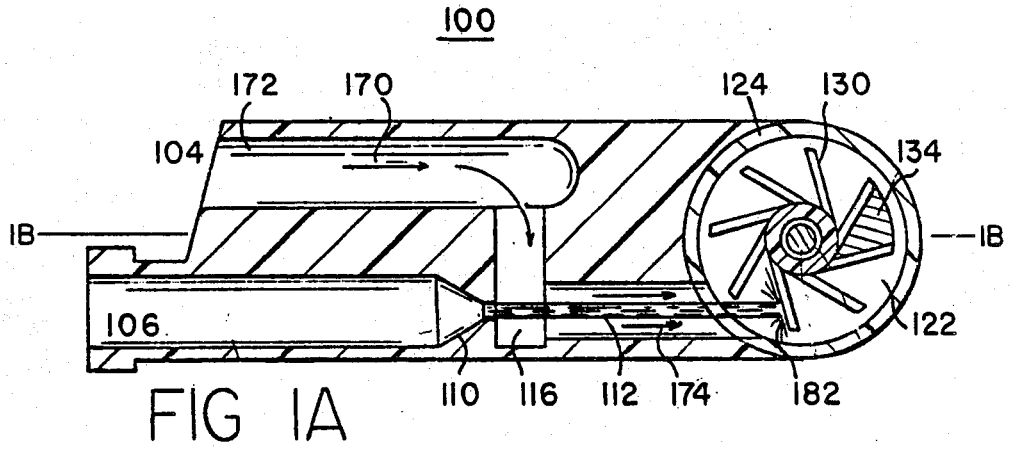
FIG 1A
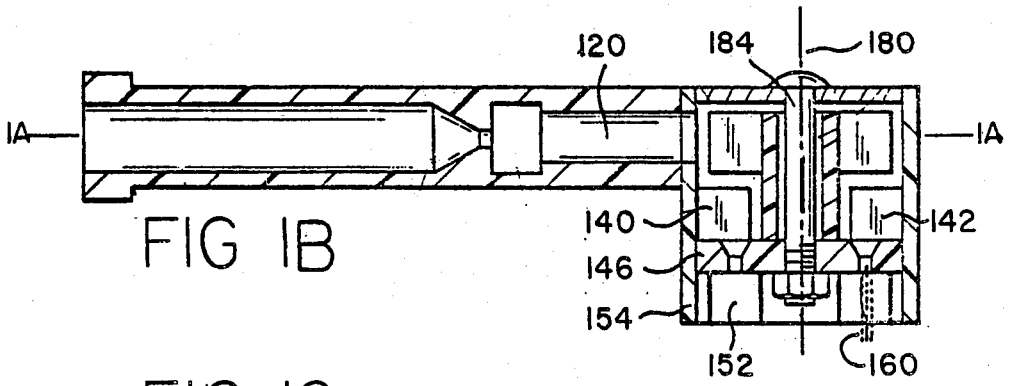
FIG 1B
FIG 1C
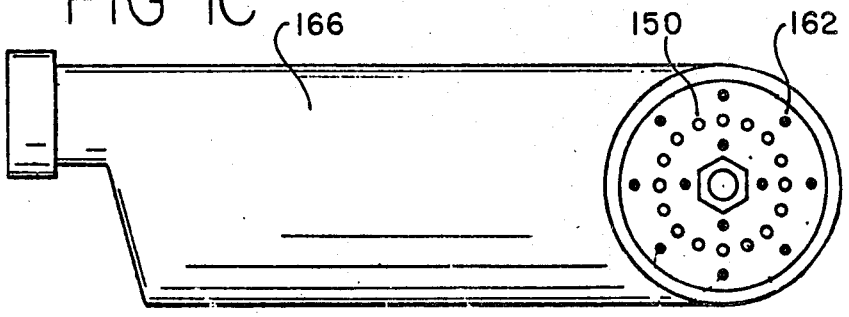

HYDRO-AIR VIBRATOR MASSAGE APPARATUS

This application is a rewritten continuation application of earlier filed copending application entitled "Hydro-Air Vibrator Massage Apparatus" Ser. No. 06/121,363, filed Feb. 14, 1980 by the present Applicant now abandoned.

TECHNICAL FIELD

This invention relates to a water-air massage device, and more particularly to a massage device in which the massage displacement is generally parallel with the region under massage.

BACKGROUND

Heretofore, water massage devices which employed entrained air used a low efficiency splash chamber to mix the air with the incoming water.

The prior art water massage devices produced an up and down pounding vibration generally perpendicular to the surface of the region under massage. The resulting displacement within the tissue under massage was highly localized and intense.

SUMMARY

It is therefore an object of this invention to provide an improved air entrainment, water massage device.

It is another object of this invention to provide a water-air massage device which conserves shower water and energy required to heat the shower water.

It is a further object of this invention to provide a water-air massage device which provides a massage motion parallel to the region under massage.

It is a further object of this invention to provide a water-air massage device which is flexible in design and application.

It is a further object of this invention to provide a water-air massage device employing water powered rotor.

It is a further object of this invention to provide a water-air massage device in which the rotor is lubricated by water.

It is a further object of this invention to provide a water-powered vibrating massage device having a pulsating output.

It is a further object of this invention to provide a water-air massage device in which the rotor supports air draw for entrainment into the water.

It is a further object of this invention to provide a water-air massage device which in which entrained air cushions the impact of the massage water.

It is a further object of this invention to provide a water-air massage device which is inexpensive, easy to install, and operable over a range of input water pressures.

Briefly, these and other objects of the present invention are accomplished by exposing a high velocity water jet flow to air defining an air-water interface. The water flow is passed through a channel for developing a adjacent sheath flow of air. The water-air flow is mixed together in a rotor chamber. A rotor device rotatably mounted within the chamber is rotationally responsive to the water-air flow about a rotation axis. The center of mass of the rotor device is offset from the rotation axis causing a rotational eccentricity sufficient to establish a counter action motion generally parallel to the region under massage. A perforated closure member extends across the rotor chamber generally orthoganal to the axis of rotation, forming a plurality of water-air streams. A diversion structure directs the water-air mixture from the rotor chamber out the perforations in the closure member. A rim cup extending from the closure member defines the region under massage by intensifying the output flow. Resilient protrusions extend from the closure member for engaging and displacing the region under massage along the counter action motion.

BRIEF DESCRIPTION OF THE DRAWING

Further objects and advantages of the massage device, and the operation of the eccentrically weighted rotor, will become apparent from the following detailed description and drawing in which:

FIG. 1A is a sectional top view of a hand held embodiment of the device showing the water source, rotor, and eccentric weight, as viewed downwardly along line IA—1A of FIG. 1B;

FIG. 1B is a sectional side view showing diversion baffles, massage fingers, and pressure cup, as viewed across the line IB—IB of FIG. 1A;

FIG. 1C is a bottom view of FIG. 1A showing a perforation and finger configuration across the output plate;

DETAILED DESCRIPTION

General Operation

Figure 2A:
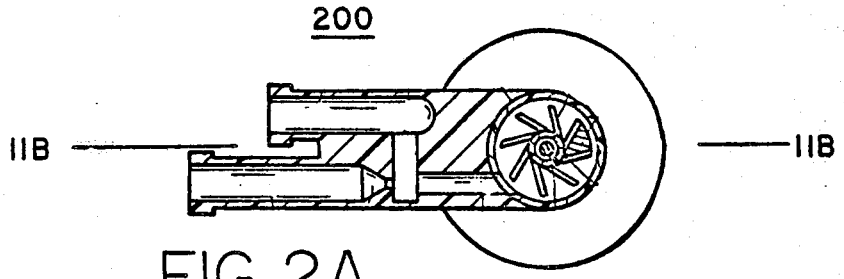
FIG. 2A is a sectional top view of a larger massage device as viewed along line IIA—IIA of FIG. 2B.

FIGS. 1A through 1C show a hand held water-air massage unit 100. Air source port 104 is open to the atmosphere, and water source port 106 connects to a suitable supply of water under pressure such as from a household faucet or shower outlet. A water oriface, with beveled approach 110, provides a high velocity jet 112 across air gap 116, through receiving channel 120, into rotor chamber 122 within housing 124. A multi-bladed rotor 130 mounted in chamber 122 rotates rapidly under the kinetic impact of water jet 112 on the rotor blades. An eccentric weight 134 creates a counter action massage motion within unit 100. Each blade developes a leading high pressure zone which continuously sweeps away the spent water from the impact area into a spinning water-air mixture. The advancing lower edge of the spinning mixture is sheared away by diversion baffle 140 causing the water-air mixture to enter diversion compartments 142. The diversion structure reduces the rotational component of the water-air motion and increases the output component or downward component. Closure plate 146 extends across the bottom of compartments 142. Perferations 150 in closure plate 146 permit the sheared water-air mixture to divert into an open ended massage chamber 152 formed by cup rim 154 to provide a plurality of water-air output streams 162. Resilient protrusions or fingers 162 extend beyond rim 154 to engage and displace the region under massage. The output flow resistance of perforations 150 causes a water reserve to accumulate in compartments 142 and chamber 122. The equilibrium level of the reserve is determined by the input pressure of water source 106 and the flow resistance through unit 100.

Unit 100 would typically be installed in a shower stall or bath for water capture (and disposal or recycle) convenience. Unit 100 may be mounted in an elevated position to function in a pulsating shower mode; or hand held to function in a massage mode. In the massage mode, the operator holds unit 100 around the body or handle portion 166, and presses rim 154 against the region to be massaged. The massage motion and output pulsations (described hereinafter) provide a stimulating gentle massage with the therapeutic benefit of entrained air. The penetration of the massage may be increased by pressing unit 100 firmly against the region under massage. The engagement between fingers 162 and the region under massage is increased firmly causing more definite massage displacement. The pulsations are intensified by water pressure build up within massage chamber 152.

Air Entrainment

Air source port 104 is vented to a suitable air supply such as the atmosphere, for providing an air flow 170 for entrainment with water jet 112 in rotor chamber 122. Air port 104 is in fluid communication with chamber 122 through air conduit 172, air gap 116, and an air sheath flow 174 around water jet 112 traveling through channel 120. An air draw into chamber 122 is created by a differential pressure effect between the atmospheric pressure at gap 116 and a low water pressure zone within chamber 122. Water jet 112 impacts on the air and water within housing 124 between the blades of rotor 130. The water-air mixture is pushed away causing the air draw. Incoming air sheath flow 174 is throughly mixed with water jet 112 therein. The water is radially deflected through the surrounding air sheath upon contact with the rotor blades, resulting in a close association therebetween.

The air draw and entrainment is disclosed in more detail in earlier filed copending application entitled Jet Air Shower Device, Ser. No. 069,631 filed Aug. 27, 1979 by the present inventor; which disclosure is hereby incorporated by reference.

The rotation of rotor 130 additionally supports the air draw through channel 120 in the embodiment shown. As each rotor blade moves forward under the force of water jet 112, a low pressure trailing zone is created behind the blade which favors the draw of air from port 104 through air sheath 174. Rotor 130 functions as a water powered air pump continuously bringing outside air into chamber 122.

Air sheath flow 174 is aided by the drag effect of water jet 112 along the water-air interface within channel 120. The major portion of the water-air interface is a cylindrical surface extending through channel 120.

Massage Displacement

Massage unit 100 provides a rotational massage motion in a plane parallel to the region under massage causing a lateral tissue displacement. The side to side displacement is disbursed over area within, and adjacent to, massage chamber 152. The massage motion is generated by eccentric weight 134 on rotor 130 which establishes a center of mass offset from rotation axis 180. As rotor 130 spins, the entire unit 100 developes a counter action rotation orthoganal to rotation axis 180. The frequency of the massage displacement is determined by the rotor speed, and may be varied by adjusting the pressure of water source 106.

Output Flow Pulsations

If desired, the region under massage may be further stimulated by pulsations in the intensity of output flow 160. Entrained air in water-air mixture 182 may be compressed by the high pressure zone created by water jet 112, which extends throughout diversion compartments 142. The compressed air expands abruptly upon passing through perforations 150 in closure member 146, causing rapid acceleration of the water in the perforation immediately preceding the expanding air. The resulting localized burst of water propagates a small pressure wave towards the region under massage. The combined effect of all the water bursts from all of the perforations establishes an incoherent pattern of small pressure transitions.

A more general output flow pulsation may be provided by the effect of eccentric weight 134 passing through jet 112. Weight 134 completely fills the space between to adjacent blades causing a temporary interruption of the water flow through chamber 122 and the high pressure through out diversion compartments 142. This step change in flow and pressure conditions establishes a corresponding step change in the intensity of output flow 160 once each rotation of rotor 130 for a time period of 45 degrees. A general pulse is propagated across the entire area of chamber 152 toward the region under massage. The air entrained within mixture 182 cushions the pulse by reducing the sharp leading and trailing edges of the pulse transition. The entrained air absorbs the high frequency component of the pulse edges causing an increase in the pulse transition time.

Water Lubrication

If desired, the vertical bearing surface between rotor 130 and axial shaft 184 and the horizontal bearing surface between rotor 130 and closure plate 146 may be lubricated by the equilibrium reserve of water-air mixture 182 within chamber 122.

The thin axial passage between shaft 184 and the surface of the axial bore through rotor 130 fills with the reserve mixture during operation and provides a continuous fluid film bearing. The centrifugal force developed by spinning weight 134 tends to maintain rotor 130 in parallel relationship with rotation axis 180 and shaft 184. The engagement between rotor 130 and shaft 184 is a rolling contact in which revolves about shaft 184 in opposition to weight 134.

Preferably, rotor 130 is formed of a suitable light weight substance to minimize the horizontal bearing contact between the bottom surface or rotor 130 and top surface of closure member 146. During operation, the buoyancy of rotor 130 reduces the downward bearing resistance.

Figure 2B:
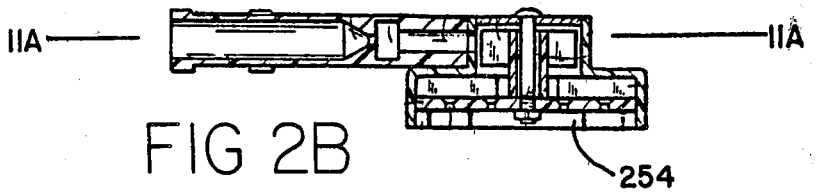
FIG. 2B is a sectional side view as viewed across line IIB—IIB of FIG. 2A.
Figure 2C:
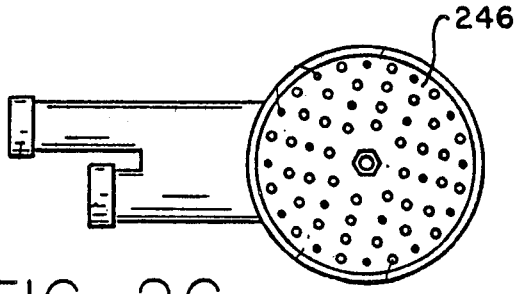
FIG. 2C is a bottom view of FIG. 2A.

FIGS. 2A through 2C show utility handheld unit 200 with a larger closure plate 246 and massage chamber 252. Unit 200 requires a higher water flow, which may be recycled at a controlled-elevated pressure to provide the desired rotor speed. Unit 200 may operated from the same water source as unit 100 of FIG. 1, at a lower rotational speed.

Figure 3A:
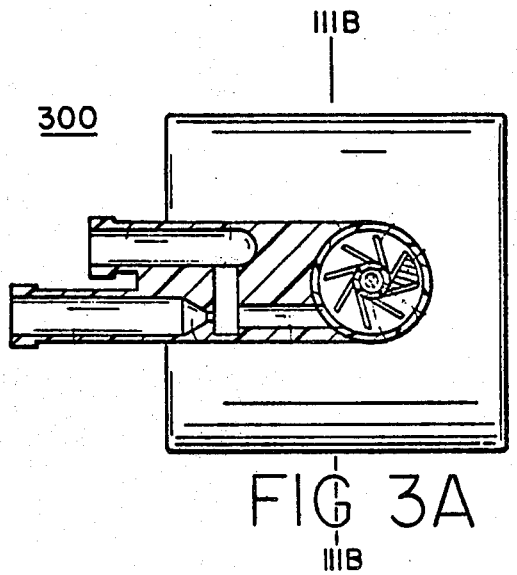
FIG. 3A is a sectional top view of a contoured massage device showing a curved massage plate.
Figure 3B:
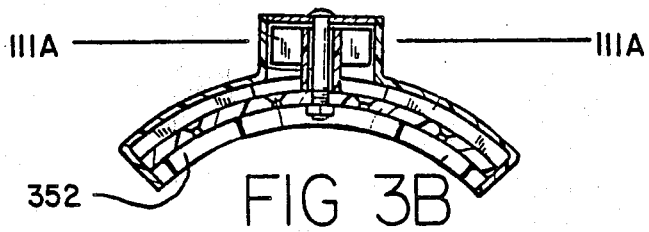
FIG. 3B is a sectional side view as viewed across line IIIB—IIIB of FIG. 3A.
Figure 3C:
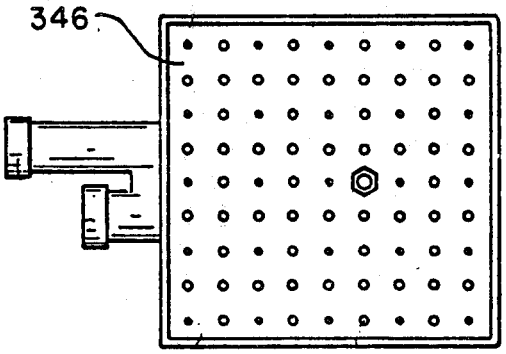
FIG. 3C is a bottom view of FIG. 3A.

FIGS. 3A through 3C show a special purpose unit 300 with a contoured closure plate 346 and massage chamber 352, suitable for accomodating specifically contoured areas. The cylindrical contour shown in FIG. 3 is particularly suited for "Charley Horse" applications involving the massage of large muscles such as thighs.

Figure 4A:
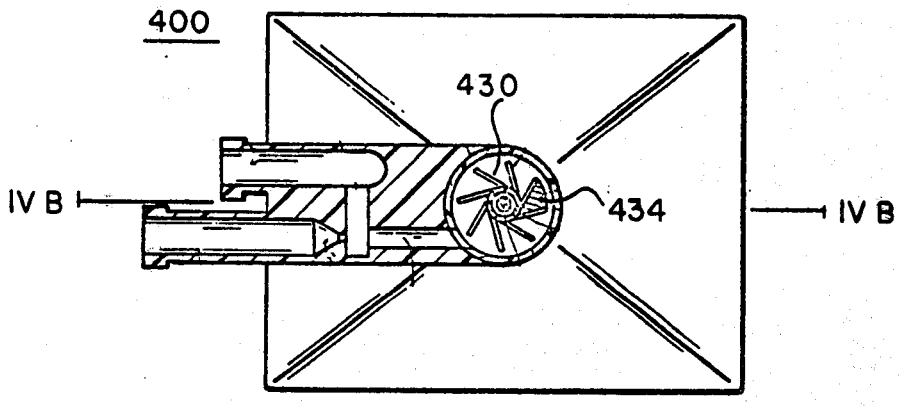
FIG. 4A is a sectional top view of a bath tub massage device as viewed along line IVA—IVA of FIG. 4B.
Figure 4B:
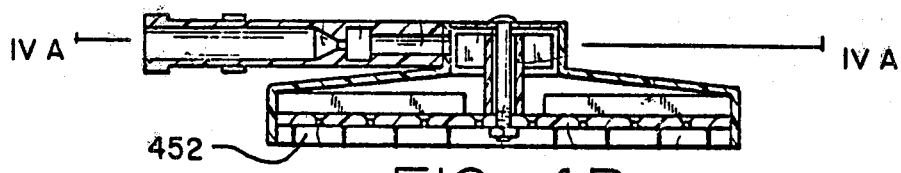
FIG. 4B is a sectional side view as viewed across line IVB—IVB of FIG. 4A.
Figure 4C:
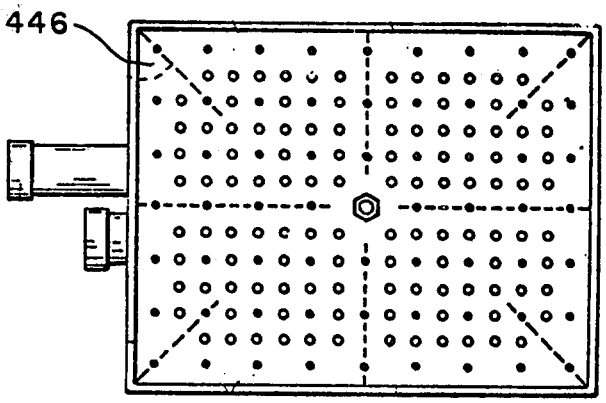
FIG. 4C is a bottom view of FIG. 4A.

FIG. 4 shows a stationary bath unit 400 with an area type closure plate 446 and massage chamber 452 for back-rest, tub mounting. Unit 400 is suitable for massaging large rheumatoidal areas such as the upper and lower back. The large massage area will require a larger rotor 430 and eccentric weight 434. The weight could occupy more than one blade position, extending for as much as 120 degrees of the rotor circumference.

SPECIFIC EMBODIMENT

The following particulars of are given as an illustrative example of workable dimensions in inches (centimeters parenthesis) for each of the embodiments.

| Element | Hand Held | Larger | Contured | Bath |
|---|---|---|---|---|
| Oriface | ⅛(0.32) | ¼(0.64) | ¼(0.64) | ⅝(1.59) |
| Gap | ⅜(0.95) | ¾(1.90) | ¾(1.90) | 6/4(3.81) |
| Channel | | | | |
| length | 5/4(3.17) | 2 (5.08) | 2 (5.08) | 3 (7.62) |
| diameter | ¼(0.64) | ⅜(0.95) | ⅜(0.95) | ¾(1.90) |
| rotor dia | 3/2(3.81) | 5 (12.7) | 5 (12.7) | |
| Plate dia | 3/2(3.81) | 5 (12.7) | 5 (12.7) | |
| Perforations | | | | |
| number | 16 | 40 | 45 | 114 |
| size | 1/16(0.16) | 1/16(0.16) | 5/32(0.40) | 5/32(0.40) |
| Fingers | | | | |
| length | ⅝(1.59) | ¾(1.90) | 1 (2.54) | 3/2(3.81) |
| number | 12 | 24 | 25 | 62 |
| Cup | | | | |
| diameter | 3/2(3.81) | 5 (12.7) | 9 (22.9) | 12(30.5) |
| depth | ½(1.27) | ½(1.27) | ¾(1.90) | 5/4(3.17) |
| Water Use | | | | |
| gal/min | 2 | 12 | 12 | 35 |
| lit/min | 7.6 | 46 | 46 | 133 |

The above values are not intended as defining limitations of the invention. Numerous other dimensions and configurations involving different applications are possible. For example, the number and size of the perforations may be varied to obtain the desired water-air reserve within the rotor chamber in applications involving higher or lower water pressure.

INDUSTRIAL APPLICABILITY

It will be apparent to those skilled in the art that the objects of this invention have been achieved by providing a self propelled, vibrating, air entrainment massage device with a pulsating output flow.

CONCLUSION

Clearly various changes may be made in the structure and embodiments shown herein without departing from the concept of the invention. For example the eccentric weight may be formed by the absence of material from the rotor such as one or more missing blades. The rotor may be positioned off center within a cylindrical housing to facilitate passage of the water-air mixture. A special therapeutic vapor or substance may be employed with or without air from the atmosphere.

Therefore, the scope of the invention is to be determined by the terminology of the following claims and the legal equivalents thereof.

I claim as my invention:

1. Water-air massage apparatus for combining a cyclic massage displacement generally parallel to the region under massage, with the pressure effect of compressing and releasing entrained air in the form of breaking air bubbles, comprising:

water source for providing a high velocity water jet flow in a direction generally parallel to the region under massage;

air source for exposing the water jet flow to air forming an sheath flow of air;

elongated channel means extending in a direction generally parallel to the region under massage, having a receiving end for receiving the water jet flow and the sheath air flow, and having an exit end for providing an exit flow of water and air;

housing means with a chamber therein for receiving and mixing the exit flow from the channel means;

rotor means rotatably mounted within the chamber and rotationally responsive to the exit flow about a rotation axis generally orthogonal to the region under massage, the rotor means having a center of mass offset from the rotation axis thereof for causing a rotational eccentricity sufficient to establish a circular counter action housing motion generally parallel to the region under massage;

perforated closure means across the housing generally parallel to the region under massage, forming a plurality of output streams of water-air mixture in a direction toward the region under massage;

baffle diversion means within the housing for receiving the water-air mixture from the chamber and redirecting the water-air mixture from a rotational flow within the chamber to a directional flow towards the region under massage, out the perforations of the closure means, the perforations restricting the flow of the output streams causing a back presure within the diversion means which compresses the air in the mixture, the compressed air expanding and rupturing after passing through the perferations creating temporary pressure bursts in the output streams;

an open ended massage chamber formed by a rim means extending from the closure means for defining the region under massage and receiving and intensifying the output streams; and resilent means extending from the closure means for engaging and laterally disturbing the region under massage by the housing counter motion in a circular displacement pattern generally parallel to the region under massage.

2. The apparatus of claim 1, wherein the closure means is a perforated plate.

3. The apparatus of claim 2, wherein the perforations in the plate are beveled around the inside.

4. The apparatus of claim 2, wherein the rim means is a cylindrical extention of the housing means.

5. The apparatus of claim 4, wherein the resilent means is a plurality of protrusions extending beyond the cylindrical cup.

6. The apparatus of claim 1, further comprising a handle portion for holding the apparatus.

7. The apparatus of claim 6, wherein the water source is a supply conduit extending through the handle portion.

8. The apparatus of claim 6, wherein the air source is vented to the atmosphere through a remote vent along the handle portion.

9. The apparatus of claim 1, wherein the water jet flow is a single jet of water, and the channel means is a single linear receiving channel.

10. The apparatus of claim 1, wherein the rotor means has a plurality of impact surfaces for converting a portion of the velocity kinetic energy of the exit flows into rotational kinetic energy around the rotor means.

11. The apparatus of claim 10, wherein the impact surfaces are radially extending blades with space therebetween.

12. The apparatus of claim 11, wherein the offset center of mass is caused by a weight means mounted on the rotor means.

13. The apparatus of claim 12, wherein the weight means fills the space between at least one pair of adjacent blades.

14. The apparatus of claim 13, wherein the interblade weight interrupts the water-air mixture flow pattern once each rotation of the rotor means causing a cyclic pulsation in the water pressure tranfered to the region number massage.

15. The apparatus of claim 13, wherein the rotation axis of the rotor means is orthoganal to the water jet flow.

16. The apparatus of claim 15, wherein the rotation axis of the rotor means is coincident with the center axis of the chamber.

17. The apparatus of claim 15, wherein the chamber has a shaft means therethrough, and the rotor means has a bearing engagement with the shaft means for supporting the rotation thereof within the chamber.

18. The apparatus of claim 17, wherein the bearing engagement is lubricated by the water-air mixture within the chamber.

19. The apparatus of claim 15, wherein the baffle diversion means is a series of baffles for reducing the rotational flow of the water-air mixture to permit the water-air mixture to flow directly out the perforations in the closure means.

20. The apparatus of claim 19, wherein the baffles divide the diversion means into a series of compartments across the closure means.

21. A method of providing a water-air massage for a region under massage, comprising the steps of:

providing a high velocity water jet generally parallel in the region under massage;

exposing the water jet to air;

passing the water jet generally centrally through a cylindrical elongated receiving tube generally parallel to the region under massage;

establishing an outer sheath flow of air through the cylindrical receiving tube around the water jet;

passing the water jet and sheath air flow into a housing;

forming a water-air mixture within the housing;

rotating an eccentric rotor within the housing about an axis generally orthogonal to the region under massage in response to the kinetic energy of the water jet;

establishing a circular housing motion generally parallel with the region under massage due to the eccentricity of the rotor;

creating a low pressure region within the housing by means of the rotating rotor for drawing additional sheath air flow into the housing;

diverting the water-air mixture towards the region under massage;

forming a plurality of water-air streams against the region under massage by means of a perforated closure member on the housing;

restricting the flow of water-air streams by limiting the size and number of the perforations causing a back pressure to develope within the housing which compresses the air in the water-air mixture;

permitting the compressed air to expand upon passing through the perforations to create temporary pressure bursts in the streams; and displacing the region under massage generally laterally in response to the circular motion of the housing.

22. The method of claim 21 further comprising the additional step of intensifying the effect of the plurality of water-air streams by a peripheral cup.

23. The method of claim 21 wherein the step of diverting the water-air mixture comprises;

reducing the rotation component of the water-air motion; and increasing the linear component of the water-air.

24. The method of claim 21, wherein the eccentric rotor has blades for receiving the water jet and a weight mounted between two adjacent blades for providing the eccentricity.

25. The method of claim 24, comprising the further step of:

pulsing the water pressure of the plurality of streams by temporarily interupting the water-air flow within the housing due to the weight passing through the water jet.

26. The method of claim 21, wherein the displacement of the region under massage is accomplished by a plurality of resilient protrusions extending from the housing for engaging the region under massage.

27. The method of claim 21, further comprising the steps of:

compressing the air within the water-air mixture in the housing; and creating temporary pressure bursts within each of the plurality of output streams due to the expanding air therein.

* * * * *